US006167852B1

(12) United States Patent
Kamimaru et al.

(10) Patent No.: US 6,167,852 B1
(45) Date of Patent: Jan. 2, 2001

(54) VALE OPENING AND CLOSING TIME DETECTING APPARATUS AND METHOD THEREOF FOR ELECTROMAGNETICALLY OPERATED VALVE MECHANISM IN INTERNAL COMBUSTION ENGINE

(75) Inventors: Shinji Kamimaru; Mitsunori Ishii, both of Tokyo (JP)

(73) Assignee: Fuji Jukogyo Kabushiki Kaisha, Tokyo (JP)

( * ) Notice: Under 35 U.S.C. 154(b), the term of this patent shall be extended for 0 days.

(21) Appl. No.: 09/185,487

(22) Filed: Nov. 3, 1998

(30) Foreign Application Priority Data

Nov. 12, 1997 (JP) ..... 9-310805

(51) Int. Cl.[7] ..... F01L 9/04
(52) U.S. Cl. ..... 123/90.11; 251/129.01
(58) Field of Search ..... 123/90.11; 251/129.01, 251/129.15, 129.16

(56) References Cited

U.S. PATENT DOCUMENTS 5,765,514 * 6/1998 Sono et al. ..... 123/90.11
5,797,360 * 8/1998 Pischinger et al. ..... 123/90.11

FOREIGN PATENT DOCUMENTS 7332044 12/1995 (JP) .

* cited by examiner

*Primary Examiner*—Weilun Lo
(74) *Attorney, Agent, or Firm*—Martin A. Farber

(57) ABSTRACT

A valve opening and closing time detecting apparatus and method of an elecromagnetically operated valve in an internal combustion engine comprises a vibration detecting means for detecting a vibration generated when the valve reaches a fully open position or when the valve reaches a valve seated position and a judging means for comparing a comparison data obtained from the vibration detecting means with a threshold value and for judging that the valve has reached the open position or the seated position when the comparison data exceeds the threshold value.

11 Claims, 3 Drawing Sheets

VALE OPENING AND CLOSING TIME DETECTING APPARATUS AND METHOD THEREOF FOR ELECTROMAGNETICALLY OPERATED VALVE MECHANISM IN INTERNAL COMBUSTION ENGINE

BACKGROUND OF THE INVENTION

1. Field of the Invention

The present invention relates to an electromagnetically operated valve for an internal combustion engine and more particularly to an apparatus and a method of detecting opening and closing time of the electomagnetically operated valve.

2. Prior Arts

In recent years, techniques in which intake and exhaust valves of internal combustion engines are electromagnetically operated and their opening and closure timings are electronically controlled, have been developed.

This electromagnetically operated valve has an advantage in that valve opening and closure timings can be established in a wide range and also can be selected properly in accordance with engine operating conditions, however, on the other hand, it has a disadvantage in that the valve is accelerated by the electromagnetic force of solenoids and the biasing force of the spring and as a result a large impact occurs when the valve is seated on a valve seat or when the valve fully opens.

To overcome this disadvantage, numerous techniques such as retarding the valve speed immediately before the valve is seated on the valve seat or fully open, have been developed. For example, Japanese Patent Application Laid-open No. Toku-Kai-Hei 7-332044 discloses a technique wherein a piezoelectric element is fixedly disposed at the position receiving pressure from an armature or an interconnecting member integrally moving together with the armature to detect a valve position based on the change of an output characteristic of the piezoelectric element.

However, in this technique, since the valve position is detected by applying a pressure directly on the piezoelectric element, it is a problem whether or not the piezoelectric element is endurable. To solve this problem, as an alternative means, the use of contactless sensors such as an eddy current position sensor and the like can be considered. However, these contactless sensors can detect a relative displacement of the valve but have a disadvantage that it is difficult due to the effect of noises contained in output signals of the sensors to detect an accurate instant when the valve is completely closed, i.e., seated on the valve seat or when the valve is fully open.

SUMMARY OF THE INVENTION

With the above described problem in mind, it is an object of the present invention to provide an improved valve opening and closing time detecting apparatus for an electromagnetically operated valve capable of accurately detecting a time of a valve fully open or completely closed. By detecting an accurate time, it becomes possible to control more correctly the velocity of the valve when the valve is seated on the valve seat or is fully open.

To achieve the object, the valve opening and closing time detecting apparatus for an electromagnetically operated valve reciprocating between a valve fully open position and a valve seated position in an engine, comprises vibration detecting means for detecting a vibration generated when the valve reaches the open position or when the valve reaches the seated position and judging means for comparing a comparison data obtained from the vibration detecting means with a threshold level and for judging that the valve has reached the open position or the seated position when the comparison data exceeds the threshold level.

DETAILED DESCRIPTION OF THE PREFERRED EMBODIMENTS

Figure 2:
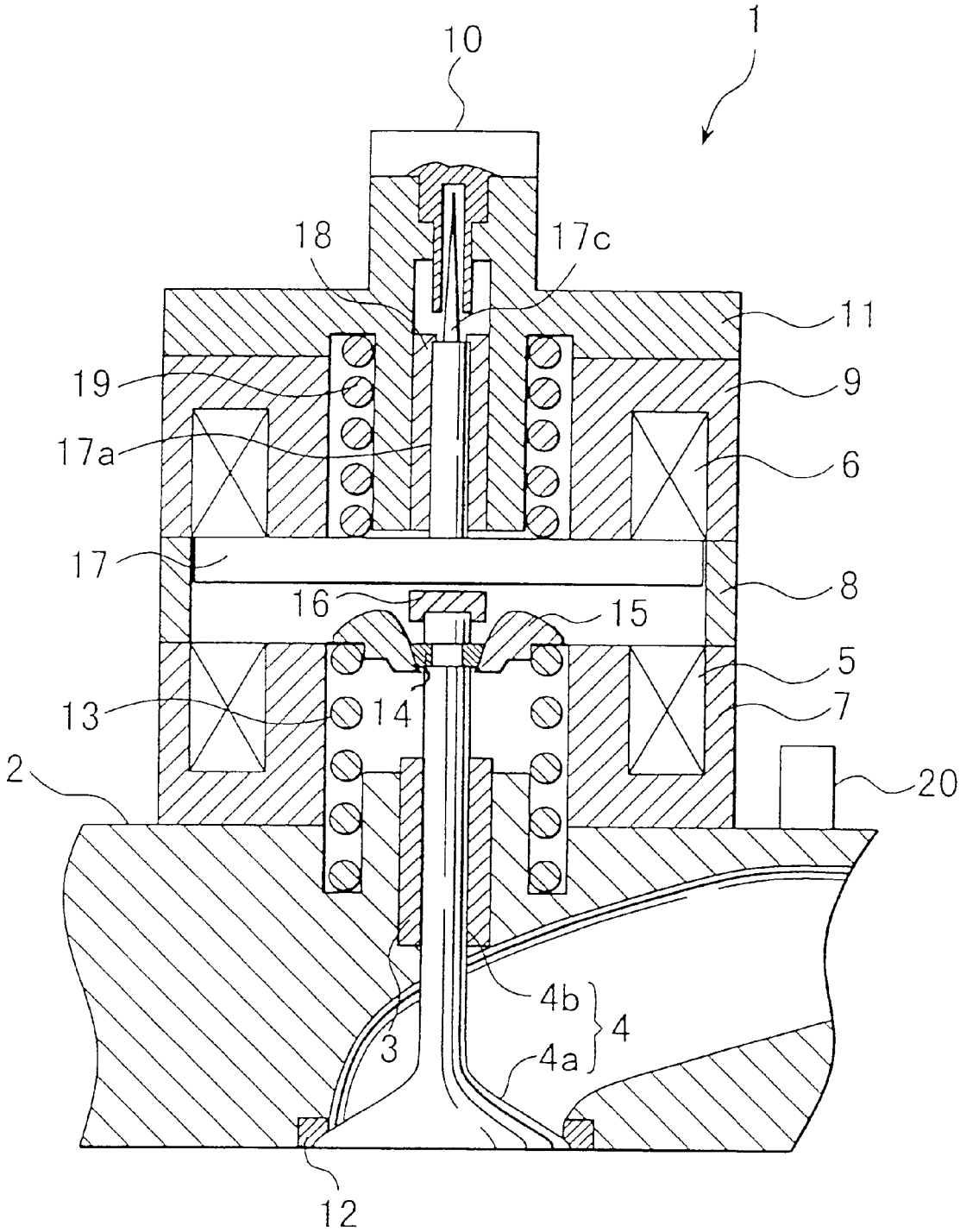
FIG. 2 is a sectional side elevation of an electromagnetically operated valve mechanism according to the present invention.

Referring now to FIG. 2, numeral 1 denotes an electromagnetically operated valve mounted on a cylinder head 2 of an engine. Numeral 4 denotes a valve (intake or exhaust valve) whose valve stem 4*b* is supported reciplocatingly by a valve stem guide 3 of the cylinder head 2. Numeral 5 denotes a valve opening solenoid and numeral 6 denotes a valve closing solenoid, respectively. The valve opening solenoid 5 and the valve closing solenoid 6 are disposed opposedly to each other.

In the electromagnetically operated valve 1, the valve opening solenoid 5 is accommodated in a yoke 7 which is mounted on the cylinder head 2. A lift adjuster 8 is mounted on the yoke 7 to act as absorbing dispersions of components and thereby adjusting a lift amount of the valve 4. Further, a yoke 9 connected with the lift adjuster 8 accommodates the valve closing solenoid 6 therein. Further, the yoke 9 is connected on the upper portion thereof with a case 11 that serves as guiding an armature 17 in the axial (vertical) direction and at the same time as accommodating an eddy current type lift sensor 10 therein. A valve closing spring 13 is accommodated inside of the valve opening solenoid 5 and it is biased so as to press a valve head 4*a* of the valve 4 on a valve seat 12. The valve closing spring 13 is interposed between a retainer 15 which is connected through a cotter pin 14 with the end of the valve stem 4*b* and a cylindrical spring holder formed around the valve stem guide 3 on the cylinder head 2. Further, there is provided with a shim 16 for adjusting a clearance on the top of the valve stem 4*b*.

Further, in a space formed on the inner periphery side of the lift adjuster 8, there is provided with a disk-like armature 17 for actuating the valve 4. Also, an armature stem 17*a* is formed integrally with the armature 17 in the center of the armature 17 and the armature stem 17*a* is reciplocatingly inserted in an armature stem guide 18 which is press-fitted to a cylindrical portion projected downward from the case 11. Further, a valve opening spring 19 is inserted to the outer periphery of the cylindrical portion and it is biased so as to urge the valve head 4*a* away from the valve seat 12.

When both the valve opening solenoid 5 and the valve closing solenoid 6 are deenergized, the armature 17, while it is in contact with the shim 16, is sustained in a middle position wherein the biasing force of the valve closing spring 13 is balanced with that of the valve opening spring 19.

Further, the upper tip of the armature stem 17*a* is formed into a needle-shape and acts as a moving target 17*c* of the lift sensor 10. Vertical traveling of the moving target 17*c* is detected by the lift sensor 10 as indicative of a lift amount of the valve 4.

Thus constituted electomagnetically operated valve 1 is controlled by a control apparatus (not shown). The control apparatus calculates valve opening and closing time of intake or exhaust valves of respective cylinders based on engine speeds, accelerator pedal opening angles, crank rotational angle indicative pulses, coolant temperature, and other miscellaneous data, and outputs driving signals to the electromagnetically operated valve 1 of relevant cylinders.

For example, when intending to operate the valve 4 from a closed position, first the valve closing solenoid 6 is deenergized and then the valve opening solenoid 5 is energized at a specified timing, thereby attractive force is generated in the valve opening solenoid 5 to attract the valve 4 through the armature 17 in the direction of the valve opening solenoid 5. The armature 17 passes the middle position where the biasing force of the valve closing spring 13 is balanced with that of the valve opening spring 19 and then stops in contact with the yoke 7. Thus, the valve 4 reaches a maximum lift position (fully open position)and the valve opening operation finishes.

On the other hand, when intending to close the valve 4 from an open position, the valve opening solenoid 5 is deenergized and then the valve closing solenoid 6 is energized at a specified timing, thereby attractive force is generated in the valve closing solenoid 6 to attract the armature 17 in the direction of the valve closing solenoid 6. The armature passes the middle position where the biasing force of the valve closing spring 13 is balanced with that of the valve opening spring 19 and then stops in contact with the yoke 9. At this time, a specified clearance is formed between the armature 17 and the shim 16 provided at the top of the valve stem 4*b* and the valve head 4*a* being pressed on the valve seat 12 by the biasing force of the valve closing spring 13, the valve 4 is seated on the valve seat 12.

Generally, in order to alleviate impacts when the armature 17 comes into contact with the yokes 7, 9 or when the valve 4 is seated, the electromagnetically operated valve mechanism is constituted such that the armature velocity is retarded by controlling a current passing through the valve opening solenoid 5 or the valve closing solenoid 6 immediately before reaching the maximum lift position or the seating position. However, if such control is relied solely on the output from the lift sensor 10, it is difficult to detect times of valve fully open or fully closed correctly due to dispersions or aged deterioration of relating components and the like, therefore an effective velocity control of the armature 17 can not be expected.

To solve the problem, the electromagnetically operated valve mechanism according to the present invention has introduced a vibration sensor 20 disposed on the cylinder head 2 in the neighborhood of the valve 4. The vibration sensor 20 is for detecting an accurate time of valve fully open or closed based on outputs therefrom.

Figure 1:
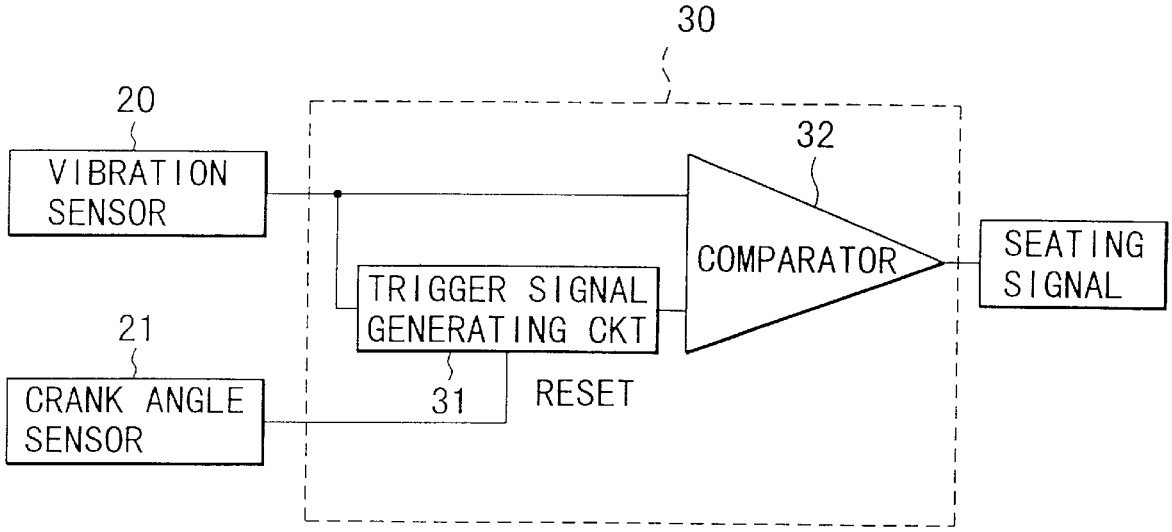
FIG. 1 is a schematic block diagram showing a valve opening and closing time detecting circuit according to a first embodiment of the present invention.

Output signals of the vibration sensor 20 are processed in a valve opening and closing time judging circuit 30 as shown in FIG. 1, from which signals indicative of valve opening and closing times are outputted to the control apparatus (not shown) Based on those signals, the control apparatus performs the velocity control of the armature 17 at the next timing of control to alleviate impacts when the valve is seated or fully open.

The valve opening and closing time judging circuit 30 comprises a trigger signal generating circuit 31 and a comparator 32. An output signal from the vibration sensor 20 is compared with a trigger signal indicative of a specified trigger level (threshold value) generated in the trigger signal generating circuit 31 and when the output signal exceeds the trigger level, a valve opening and closing time indicative signal is outputted from the comparator 32.

The trigger signal generating circuit 31 is for outputting a trigger signal having a threshold value which will be described hereinafter for judging a valve opening or closing time. In this embodiment, the trigger signal generating circuit 31 is constituted by a gradual discharge type peak hold circuit for holding a peak value of the output from the vibration sensor 20 by means of a holding condenser and the like, and a circuit for outputting a trigger signal having a 1/X (X; optional value) times level of the peak value held in the peak hold circuit to the comparator 32. In this case, the 1/X times level of the peak value becomes a threshold value for judging a valve opening and closing time. Further, this trigger signal is updated by resetting the peak value by discharging the holding condenser based on a signal issued from a crank angle sensor 21 every specified number of rotation of the engine.

Alternatively, the trigger signal generating circuit 31 may be constituted so as to output as a trigger signal a predetermined voltage, for example, a 1/X times voltage of a blueprint peak value of the output from the vibration sensor 20 or a 1/X times voltage of an experimentally obtained magnitude of vibration generated when the valve is fully open or when the valve is seated.

Figure 3:
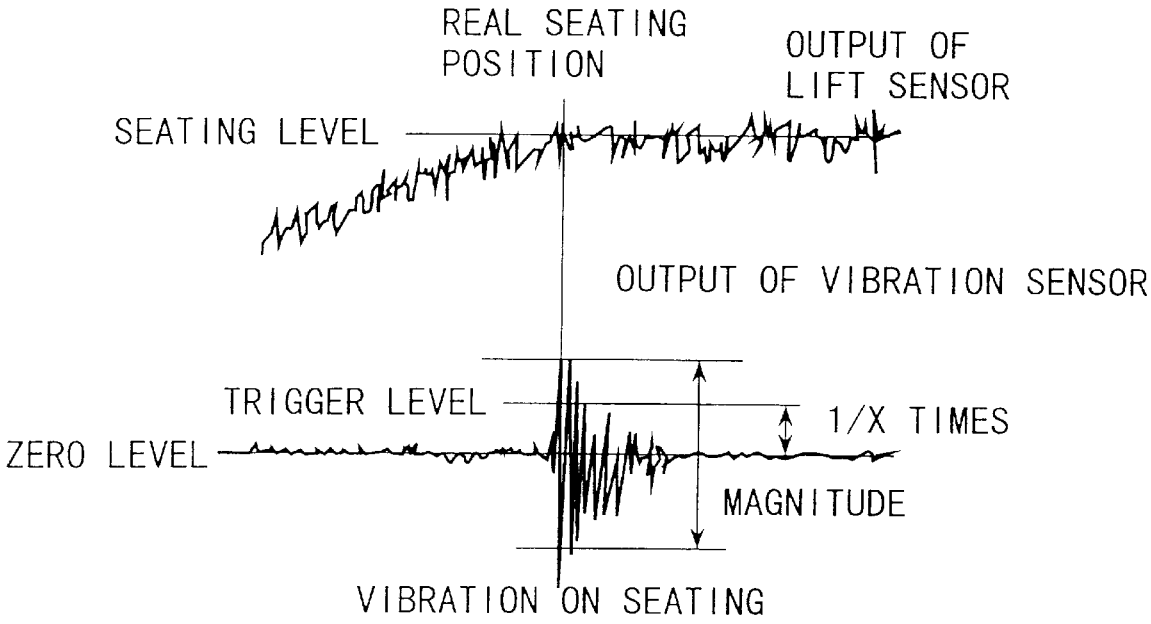
FIG. 3 is an explanatory view showing a relationship between an output of a lift sensor and an output of a vibration sensor.

FIG. 3 shows a wave shape of vibration generated when the valve closing solenoid 5 is energized to attract the armature 17 and the valve head 4*a* of the valve 4 comes into contact with the valve seat 12. The vibration transmitted through the valve seat 12 is detected by the vibration sensor 20 and is inputted to the valve opening and closing time judging circuit 30.

The trigger signal generating circuit 31 holds the peak value of the magnitude of the wave shape which is outputted from the vibration sensor 20 and outputs as a trigger signal a 1/X times signal of the peak value to the comparator 32. The comparator 32 compares the output from the vibration sensor 20 with the trigger signal and outputs the valve opening and closing time indicative signal, when the output level of the vibration sensor 20 exceeds the trigger level, i.e., the threshold value of the trigger signal.

Thus, it is possible to detect a time when the valve is fully open or seated on the valve seat correctly and speedily by using the vibration sensor, thereby it is possible to enhance a controllability in the velocity control of the electomagnetically operated valve. Further, by changing the trigger level for judging the opening and closing time according to an actually detected magnitude level of vibration, or by updating the trigger level into a newest value every specified number of rotation of the crank shaft, it is possible to delete the effect of dispersions or aged deterioration of components.

Figure 4:
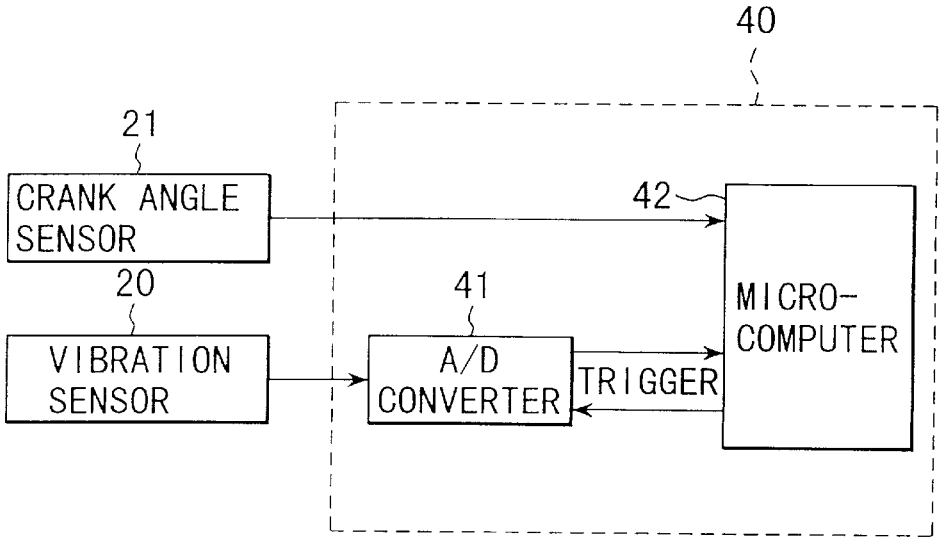
FIG. 4 is a schematic block diagram showing a valve opening and closing time detecting circuit according to a second embodiment of the present invention.

FIG. 4 shows a valve opening and closing time judging circuit 40 according to a second embodiment of the present invention.

In this embodiment, signals outputted from the vibration sensor 20 are subjected to an A/D conversion and the digitized data are processed in a micro-computer to obtain valve opening or closing times therefrom. The valve opening and closing time judging circuit 40 comprises an A/D converter 41 and a micro-computer 42.

The micro-computer 42 sends a trigger signal to the A/D converter 41 at a short interval of time to receive sampled-digital data of the output of the vibration sensor 20 and compares these sampled data with a specified threshold value to judge a valve opening or closing time.

The threshold value is established to be a value calculated from the output of the vibration sensor 20, in this embodiment, an X times value of the mean value of the background output of the vibration sensor 20 at the time when the valve is away from the positions, valve fully open and valve fully closed.

In this case, the threshold level established based on the output of the vibration sensor 20 is updated by a signal from the crank angle sensor 21 every specified number of rotation of the crank shaft.

Further, the sampled-data from the vibration sensor 20 are compared with thus established threshold level. In case where those sampled-data exceed consecutively the threshold level at larger than specified frequency or more than a specified period of time, it is judged that the valve has reached a valve fully opened or fully closed position. On the other hand, in case where those sampled-data exceed the threshold value at smaller than specified frequency or less than a specified time, those data are judged to be noises.

As an alternative way of establishing the threshold value, the threshold value may be stored in the micro-computer 42 in a form of fixed data, for example, a 1/X times value of a blueprint output value of the vibration sensor 20. Further, the threshold level may be established to be a 1/X times value of the peak output value of the vibration sensor 20, or an X times value of the mean value of magnitudes detected by the vibration sensor 20.

Further, in this embodiment, the sampled-data are employed for the comparison data as they are, however, alternatively, the comparison data may be a calculated value, for example, an absolute value of the difference between the sample-data and the mean value of magnitudes.

The feature of the second embodiment is to be able to delete noises from the sampled-data more effectively, thereby the reliability of the apparatus is substantially improved.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A valve opening and closing time detecting apparatus for an electromagnetically operated valve (1) provided on a cylinder head (2) of an internal combustion engine having: a valve body (4) inserted in said cylinder head (2) for closing a port provided therein by tightly seating a valve head **(4*a*) of said valve body (4) on a valve seat (12) and for opening said port by keeping said valve head (4*a*) away from said valve seat (12), an armature (17) provided on said valve head (4*a*) in a lift adjuster (8), a first coil (5) provided to surround a stem (4*b*) of said valve body (4) for opening said port by drawing said armature (17) against a closing force of a first spring (13), a second coil (6) provided on said armature (17) for closing said port by drawing thereof against an opening force of a second spring (19), and a crank angle sensor (21)** for detecting a number of crank-shaft revolutions of said engine and for producing an r.p.m. signal, comprising:

a vibration sensor (20) directly attached to said cylinder head (2) proximate to said first coil (5) for receiving only a vibration of said valve body (4) when said valve head **(4*a*) contacts upon said valve seat (12), and reaches a maximum lifted position from said valve seat (12)** while said engine is operating and for generating a vibration signal;

trigger signal generating means (31) responsive to said r.p.m. signal and said vibration signal for storing threshold values of vibrations corresponding to each r.p.m. and for producing a trigger signal; and judging means (30) responsive to said vibration signal and said trigger signal for deciding exact closing and opening times of said valve (1) by comparing said vibration signal with said threshold values corresponding to a present r.p.m. so as to avoid receiving noises due to aging and manufacturing allowances of said valve (1) by an installation of said vibration sensor (20) in immediate vicinity of said valve.

2. The valve opening and closing time detecting apparatus according to claim 1, wherein;

said threshold value is a predetermined fixed value at any engine r.p.m.

3. The valve opening and closing time detecting apparatus according to claim 1, wherein:

said threshold value is variable in accordance with a magnitude of said vibration signal.

4. The valve opening and closing time detecting apparatus according to claim 3, wherein:

said threshold value can be updated at any engine r.p.m.

5. The valve opening and closing time detecting apparatus according to claim 3, wherein:

said magnitude is a peak value of said vibration signal.

6. The valve opening and closing time detecting apparatus according to claim 3, wherein:

said magnitude is a mean value of said vibration signal when said valve is between a maximum lifted position and a valve seat position.

7. A valve opening and closing time detecting apparatus for an electromagnetically operated valve (1) provided on a cylinder head (2) of an internal combustion engine having: a valve body (4) inserted in said cylinder head (2) for closing a port provided therein by tightly seating a valve head **(4*a*) of said valve body (4) on a valve seat (12), and for opening said port by keeping said valve head (4*a*) away from said valve seat (12), an armature (17) provided on said valve head (4*a*) in a lift adjuster (8), a first coil (5) provided to surround a stem (4*b*) of said valve body (4) for opening said port by drawing said armature (17) against a closing force of a first spring (13), a second coil (6) provided on said armature (17) for closing said port by drawing thereof against an opening force of a second spring (19), and a crank angle sensor (21)** for detecting a number of crank-shaft revolutions of said engine and for producing an r.p.m. signal, comprising:

a vibration sensor (20) directly attached to said cylinder head (2) in proximity to said first coil (5) for receiving only a vibration of said valve body (4) when said valve head **(4*a*) contacts upon said valve seat (12), and reaches a maximum lifted position from said valve seat (12)** while said engine is operating and for generating a vibration signal;

trigger signal generating means (31) responsive to said r.p.m. signal and said vibration signal for storing threshold values of vibrations corresponding to each engine revolution, and for producing a trigger signal; and judging means (30) responsive to said vibration signal and said trigger signal for deciding exact closing and opening times of said valve (1) when said vibration signal becomes far larger than a predetermined threshold frequency value corresponding to a present r.p.m. so as to avoid receiving noises due to aging and manufacturing allowances of said valve (1) by a close installation of said vibration sensor (20) in immediate vicinity thereof.

8. A valve opening and closing time detecting apparatus for an electromagnetically operated valve (1) provided on a cylinder head (2) of an internal combustion engine having: a valve body (4) inserted in said cylinder head (2) for closing a port provided therein by tightly seating a valve head (4*a*) of said valve body (4) on a valve seat (12), and for opening said port by keeping said valve head (4*a*) away from said valve seat (12), an armature (17) provided on said valve head (4*a*) in a lift adjuster (8), a first coil (5) provided to surround a stem (4*b*) of said valve body (4) for opening said port by drawing said armature (17) against a closing force of a first spring (13), a second coil (6) provided on said armature (17) for closing said port by drawing thereof against an opening force of a second spring (19), and a crank angle sensor (21) for detecting a number of crank-shaft revolutions of said engine and for producing an r.p.m. signal, comprising:

a vibration sensor (20) directly attached to said cylinder head (2) in proximity to said first coil (5) for receiving only a vibration of said valve body (4) when said valve head (4*a*) contacts upon said valve seat (12), and reaches a maximum lifted position from said valve seat (12) while said engine is operating and for generating a vibration signal;

trigger signal generating means (31) responsive to said r.p.m. signal and said vibration signal for storing threshold values of vibrations corresponding to each engine revolution and for producing a trigger signal; and judging means (30) responsive to said vibration signal and said trigger signal for deciding exact closing and opening times of said valve (1) when said vibration signal consequently exceeds one of said threshold values, for more than a predetermined time period, so as to avoid receiving noises due to aging and manufacturing allowances of said valve (1) by installation of said vibration sensor (20) in immediate vicinity of said valve.

9. A valve opening and closing time detection method for an electromagnetically operated valve (1) provided on a cylinder head (2) of an internal combustion engine having: a valve body (4) inserted in said cylinder head (2) for closing a port provided therein by tightly seating a valve head (4*a*) of said valve body (4) on a valve seat (12), and for opening said port by keeping said valve head (4*a*) away from said valve seat (12), an armature (17) provided on said valve head (4*a*) in a lift adjuster (8), a first coil (5) provided to surround a stem (4*b*) of said valve body (4) for opening said port by drawing said armature (17) against a closing force of a first spring (13), a second coil (6) provided on said armature (17) for closing said port by drawing thereof against an opening force of a second spring (19), and a crank angle sensor (21) for detecting a number of crank-shaft revolutions of said engine, comprising the steps of:

providing a vibration sensor (20) directly to said cylinder head (2) in proximity to said first coil (5);

receiving only a vibration of said valve body (4) when said valve head (4*a*) contacts upon said valve seat (12), and reaches a maximum lifted position from said valve seat (12) while said engine is operating;

storing threshold values of vibrations corresponding to each engine revolution; and deciding exact closing and opening times of said valve (1) when said vibration becomes larger than said threshold value so as to avoid receiving noises due to aging and manufacturing allowances of said valve (1) by installing said vibration sensor (20) in proximity of said valve (1) on said cylinder head.

10. A valve opening and closing time detecting method for an electromagnetically operated valve (1) provided on a cylinder head (2) of an internal combustion engine having: a valve body (4) inserted in said cylinder head (2) for closing a port provided therein by tightly seating a valve head (4*a*) of said valve body (4) on a valve seat (12), and for opening said port by keeping said valve head (4*a*) away from said valve seat (12), an armature (17) provided on said valve head (4*a*) in a lift adjuster (8), a first coil (5) provided to surround a stem (4*b*) of said valve body (4) for opening said port by drawing said armature (17) against a closing force of a first spring (13), a second coil (6) provided on said armature (17) for closing said port by drawing thereof against an opening force of a second spring (19), and a crank angle sensor (21) for detecting a number of crank-shaft revolutions of said engine, comprising the steps of:

providing a vibration sensor (20) directly to said cylinder head (2) in proximity to said first coil (5);

receiving only a vibration of said valve body (4) when said valve head (4*a*) contacts upon said valve seat (12), and reaches a maximum lifted position from said valve seat (12) while said engine is operating;

storing threshold values of vibrations corresponding to each engine revolution; and deciding exact closing and opening times of said valve (1) when said vibration becomes larger than a predetermined frequency value so as to avoid receiving noises due to aging and manufacturing allowances of said valve (1) by installing said vibration sensor (20) in proximity to said valve (1) on said cylinder head.

11. A valve opening and closing time detecting method for an electromagnetically operated valve (1) provided on a cylinder head (2) of an internal combustion engine having: a valve body (4) inserted in said cylinder head (2) for closing a port provided therein by tightly seating a valve head (4*a*) of said valve body (4) on a valve seat (12), and for opening said port by keeping said valve head (4*a*) away from said valve seat (12), an armature (17) provided on said valve head (4*a*) in a lift adjuster (8), a first coil (5) provided to surround a stem (4*b*) of said valve body (4) for opening said port by drawing said armature (17) against a closing force of a first spring (13), a second coil (6) provided on said armature (17) for closing said port by drawing thereof against an opening force of a second spring (19), and a crank angle sensor (21) for detecting a number of crank-shaft revolutions of said engine, comprising the steps of:

providing a vibration sensor (20) directly to said cylinder head (2) at a very close position to said first coil (5);

receiving only a vibration of said valve body (4) when said valve head (4*a*) contacts upon said valve seat (12), and reaches a maximum lifted position from said valve seat (12) while said engine is operating;

storing threshold values of vibrations corresponding to each engine revolution; and deciding exact closing and opening times of said valve (1) when said vibration becomes larger than one of said threshold values for more than a predetermined time period so as to avoid receiving noises due to aging and manufacturing allowances of said valve (1) by installing said vibration sensor (20) in proximity of said valve (1) on said cylinder head.

* * * * *